United States Patent [19]

Kapp

[11] Patent Number: 4,745,888

[45] Date of Patent: May 24, 1988

[54] TAPPET SLEEVE LUBRICATION

[75] Inventor: Gerald E. Kapp, Lansing, Mich.

[73] Assignee: General Motors Corporation, Detroit, Mich.

[21] Appl. No.: 72,365

[22] Filed: Jul. 13, 1987

[51] Int. Cl.[4] ..... F01M 1/06

[52] U.S. Cl. ..... 123/90.33; 123/90.51; 123/90.55

[58] Field of Search ..... 123/90.51, 90.55, 90.33, 123/90.49

[56] References Cited

U.S. PATENT DOCUMENTS 3,880,127 4/1975 Abell, Jr. ..... 123/90.33

3,967,602 7/1976 Brown ..... 123/90.55

*Primary Examiner*—E. Rollins Cross

*Attorney, Agent, or Firm*—Robert J. Outland

[57] ABSTRACT

Leakage of gallery oil delivered to iron sleeves or the like cast into an aluminum tappet carrier through the opening of interfaces between the sleeves and the aluminum body is minimized by forming feed passages from the gallery wholly in aluminum material extending through larger openings in the sleeves so as to deliver the oil directly to the tappet bores without intersecting the aluminum-iron interface.

3 Claims, 1 Drawing Sheet

TAPPET SLEEVE LUBRICATION

TECHNICAL FIELD

This invention relates to means for lubrication of reciprocating members in cylindrical sleeves and, in a particular embodiment, to an engine construction for lubrication from a pressure oil gallery of valve tappets reciprocable in iron sleeves cast in an aluminum body and charging of hydraulic lash adjusters carried by the tappets.

BACKGROUND

It is known to provide pressurized oil from an internal gallery to the tappet bores of an internal combustion engine body, such as a cylinder block, cylinder head or separate tappet carrier, for lubricating the tappets reciprocating motion in the bores as well as for charging hydraulic lash adjusters which may be located within the tappet bodies.

In an engine construction, an aluminum camshaft carrier was proposed to also act as a tappet carrier. To minimize changes in tappet bore clearance during operation, cast iron sleeves were cast within the aluminum body to form the tappet bores. Pressure oil was delivered to the bores through openings in the sleeves communicating through passages in the supporting aluminum directly with the oil gallery.

It was found, however, that in operation, leak paths developed between the sleeves and the aluminum carrier body, possibly caused by differential growth of the aluminum and iron materials and a lack of bonding between them. This allowed the escape of a substantial volume of oil from the pressurized oil gallery with corresponding reductions in the engine oil pressure and the ability to deliver oil to the lash adjusters.

SUMMARY OF THE INVENTION

The present invention minimizes the problem of leak paths from the high pressure oil gallery connecting passages through the aluminum-iron interfaces by avoiding communication of the interfaces with the high pressure passages and by changing the leak paths to extended more tortuous configurations. The flow areas of the leak paths may also be reduced.

These results are accomplished by increasing the size of the sleeve openings and forming the passages connecting the high pressure oil gallery with the interior of the tappet bores entirely from aluminum body material cast through the sleeve openings and forming portions of the tappet bores. The high pressure oil is then delivered to the tappet bodies wholly through passages in the cast aluminum material. The aluminum-iron interfaces open to the tappet bores only at locations surrounding the oil passages where the oil pressure is generally reduced. Also, the paths from the bore ends of the interface to the exterior of the sleeves are more tortuous and leak resistant.

As a result, oil leakage from the lifter gallery passages is reduced and the potential for reduction in engine oil pressure therefrom is minimized.

These and other features and advantages of the invention will be more fully understood from the following description of a selected embodiment of the invention taken together with the accompanying drawings.

BRIEF DRAWING DESCRIPTION

In the drawings:

FIG. 1 is a transverse cross-sectional view of the upper portion of an engine showing the valve actuating mechanism with tappet lubrication means according to the invention; and FIG. 2 is an enlarged view of the portion lying generally within the closed dashed line 2 of FIG. 1.

DETAILED DESCRIPTION

Figure 1:
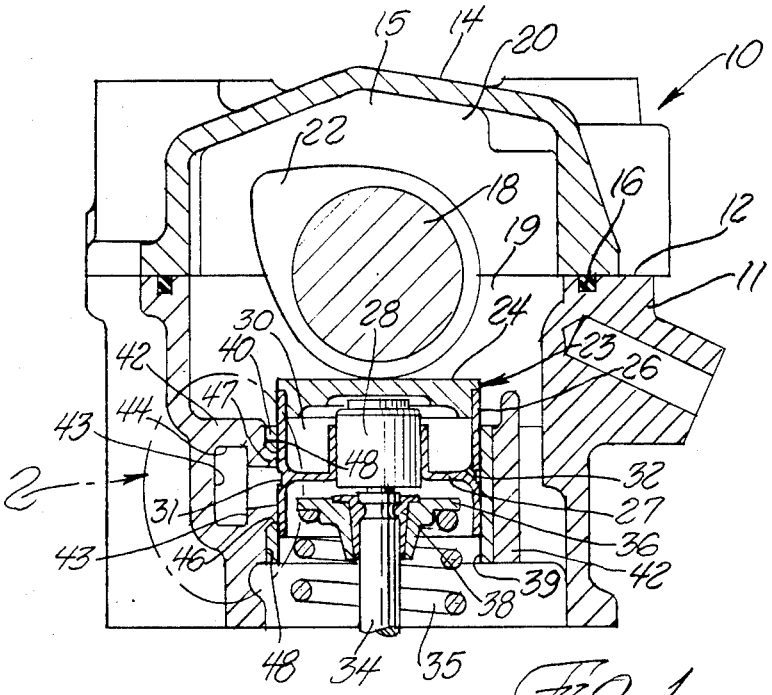
Figure 2:
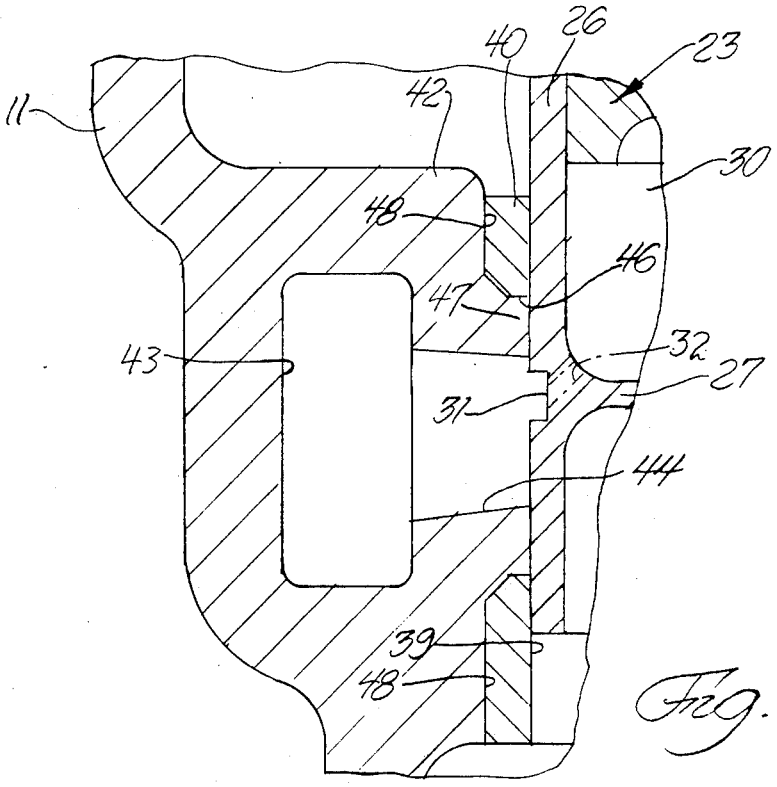

Referring now to the drawings in detail, numeral 10 generally indicates an internal combustion engine of the overhead camshaft type and including a cast aluminum camshaft carrier 11 supported on a cylinder head, not shown, and having an open upper side 12 closed by an aluminum cam cover 14. Together, the carrier 11 and cover 14 enclose a camshaft compartment 15 sealed at the joint by suitable means, such as a groove carried resilient seal 16 and containing an overhead camshaft 18.

The camshaft 18 is rotatably supported on webs 19, 20 of the carrier 11 and cover 14, respectively. Camshaft bearings, not shown, may be formed by machined portions of the aluminum webs or, if desired, could be comprised of separate inserts. Camshaft 18 includes a plurality of cams 22, each of which directly actuates a valve tappet 23.

Each tappet 23 includes a cam engaging upper end 24 and a depending skirt 26 having a central wall 27 inwardly supporting a hydraulic lash adjuster 28. A pressure oil feed chamber 30 formed within each tappet 23 communicates with the associated lash adjuster to supply makeup oil thereto. A groove 31 around the central portion of the skirt 26 and one or more drilled openings 32 connecting the chamber 30 with the groove 31 are provided for conducting oil to the chamber 30.

Each lash adjuster 28 directly engages the stem 34 of one of a plurality of valves carried in known manner by the cylinder head, not shown. The valves are biased in closing directions by valve springs 35 acting against spring seats 36 conventionally retained on the ends of the associated valve stems 34 by keepers 38.

The tappets 23 are reciprocably carried in the machined bores 39 of cast iron sleeves 40 which are, in turn, cast directly into the aluminum material of a tappet gallery 42 formed integral with the camshaft carrier 11. Adjacent to the sleeves 40 and extending longitudinally within the carrier 11 is a high pressure oil gallery 43 communicating with each of the tappet bores 39 through cored feed passages 44.

In accordance with the invention, the feed passages 44 are formed wholly within the aluminum material of the camshaft carrier 11 which extends to the tappet bores through larger openings 46 formed in the cast iron sleeves 40. Thus, protruding ends 47 of the aluminum carrier material form portions of the machined tappet bores 39 in which the tappets 23 are carried. These ends 47 form islands of aluminum around the passages 44 which separate the passages from the interfaces 48 between the iron sleeves 40 and the aluminum material of the camshaft carrier 11 in which the sleeves are cast.

The oil gallery 43 forms a part of the engine high pressure lubricating oil distribution system which conventionally receives pressurized lubricating oil from an engine oil pump, not shown. The feed passages 44 are located so as to be in register with the tappet oil grooves 31, preferably at all times but at least when the valves are in their closed positions.

During engine operation, oil is delivered under pressure from the oil gallery 43 through the feed passages 44 to the tappet bores 39 to lubricate the tappets and through the grooves 31 and openings 32 to the oil chambers 30 to supply the lash adjusters 28 with pressurized makeup oil. While differential expansion between the iron sleeves and the aluminum carrier material may tend to cause minute clearances to develop at the interfaces 48 between them during operation, this condition is limited around the feed passages 44 by the casting of the aluminum portions through the sleeve openings 46.

This construction is believed to minimize interface separation around the location of the passage 44 as well as to further limit oil leakage through the interfaces due to the tortuous configurations of the leak paths from the tappet bores. Most important, the separation of the interfaces from intersection with their adjacent oil feed passages 44 reduces the conduction of high pressure oil directly to the interfaces 48 and further limits the loss of oil therethrough, thereby maintaining oil pressure delivered to the tappets and lash adjusters at a suitably high level.

While the invention has been described by reference to a preferred embodiment, it should be understood that numerous changes could be made within the spirit and scope of the inventive concepts described. Accordingly it is intended that the invention not be limited to the described embodiment, but that it have the full scope permitted by the language of the following claims.

The embodiments of the invention in which an exclusive property or privilege is claimed are defined as follows:

1. In combination, a non-ferrous body containing a lubricant distribution gallery, a sleeve of material diverse from that of the body and cast within the non-ferrous material thereof to form internally a bore for the reciprocating movement of a lubricated member, said sleeve having an opening on a side toward the lubricant gallery through which there protrudes an extension of the non-ferrous material to form a portion of the bore, said sleeve having externally and in the opening an interface with the non-ferrous material of the body, and an oil feed passage from the gallery through the non-ferrous material extension to the bore, said feed passage being wholly within the non-ferrous material and free of any intersection with the diverse material interface, whereby any leakage of pressure oil directly from the feed passage through the interface is avoided.

2. For use in an internal combustion engine, a tappet gallery cast in aluminum and adjoining an oil gallery, a cast iron sleeve cast within the aluminum material of the tappet gallery to form internally a bore for the reciprocating movement of a lubricated tappet member, said sleeve having an opening on a side toward the oil gallery through which there protrudes an extension of the aluminum material to form a portion of the tappet bore, said sleeve having externally and in the opening an interface with the aluminum material of the tappet gallery, and an oil feed passage from the oil gallery through the aluminum material extension to the tappet bore, said feed passage being wholly within the aluminum material and free of any intersection with the iron-aluminum interface, whereby any leakage of pressure oil directly from the feed passage through the interface is avoided.

3. The combination in an internal combustion engine of, a tappet gallery cast in aluminum and containing an oil gallery, a cast iron sleeve cast within the aluminum material of the tappet gallery to form internally a tappet bore, said sleeve having an opening on a side toward the oil gallery through which there protrudes an extension of the aluminum material to form a portion of the tappet bore, said sleeve having externally and in the opening an interface with the aluminum material of the tappet gallery, a cylindrical tappet reciprocable in the tappet bore and carrying a hydraulic valve lash adjuster fed from an oil chamber within the tappet, said tappet having an external groove within the bore and at least one opening communicating the groove with the oil chamber, and an oil feed passage from the oil gallery through the aluminum material extension to the tappet bore and communicating with the tappet groove for delivering pressure oil from the oil gallery to the tappet bore and to the internal oil chamber for feeding the hydraulic lash adjuster, said feed passage being wholly within the aluminum material and free of any intersection with the iron-aluminum interface, whereby there is avoided any reduction of oil pressure delivered to the tappet and its associated lash adjuster due to leakage of pressure oil directly from the feed passage through the interface.

* * * * *